United States Patent [19]

Chiaramonte

[11] 4,312,740

[45] Jan. 26, 1982

[54] PROCESS FOR MAXIMIZING OIL YIELD IN THE RETORTING OF OIL SHALE

[75] Inventor: Gerald R. Chiaramonte, Arvada, Colo.

[73] Assignee: Tosco Corporation, Los Angeles, Calif.

[21] Appl. No.: 97,718

[22] Filed: Nov. 27, 1979

Related U.S. Application Data

[63] Continuation-in-part of Ser. No. 884,492, Apr. 8, 1978, abandoned.

[51] Int. Cl.[3] ..... C10G 1/00; C10G 9/28; C10B 47/00; C10B 21/20

[52] U.S. Cl. ..... 208/11 R; 208/127; 201/12; 202/99; 202/108

[58] Field of Search ..... 208/11 R, 127; 201/12; 202/99, 108

[56] References Cited

U.S. PATENT DOCUMENTS

| | | | |
|---|---|---|---|
| 2,550,432 | 4/1951 | Thompson | 208/11 R |
| 2,581,041 | 1/1952 | Ogorzoly et al. | 208/11 R X |
| 2,618,589 | 11/1952 | Nicholson et al. | 201/4 |
| 2,623,815 | 12/1952 | Roetheli et al. | 201/31 |
| 2,634,233 | 4/1953 | Nicoli et al. | 201/28 |
| 2,643,219 | 6/1953 | Can, Jr. et al. | 201/31 X |
| 2,736,687 | 2/1956 | Burnside et al. | 208/127 |
| 3,022,246 | 2/1962 | Moser, Jr. | 208/127 |
| 3,167,494 | 1/1965 | Crawford | 208/8 R |
| 3,617,468 | 11/1971 | Reyburn et al. | 208/11 |
| 3,691,056 | 9/1972 | Barney et al. | 208/11 R |
| 3,703,442 | 11/1972 | Rammler et al. | 208/11 R X |
| 3,784,462 | 1/1974 | Frick | 208/11 R |
| 3,972,801 | 8/1976 | Gregoli | 208/11 R |
| 4,057,490 | 11/1977 | Wynne | 208/127 |
| 4,064,018 | 12/1977 | Choi | 208/8 R |
| 4,263,124 | 4/1981 | Wickstrom et al. | 208/11 RX |

*Primary Examiner*—Andrew Metz
*Assistant Examiner*—William G. Wright
*Attorney, Agent, or Firm*—Poms, Smith, Lande & Rose

[57] ABSTRACT

An improved method for retorting oil shale with heat-carrying bodies comprising relatively coarse attrition resistant, non-oil sorbing, shale ash particles wherein oil recovery is maximized. After retorting, the spent oil shale and heat-carrying bodies are transferred to a reheating vessel or combustor. The reheating vessel contains a dense phase fluidized bed wherein the fixed carbon contained in the spent shale is combusted at temperatures between 1100° F. and 1600° F. to reheat the heat-carrying bodies. The invention is based on the finding that the decomposition of kerogen, which is present as a binder in raw oil shale, leaves pores within kerogen-rich shale which results in relatively large surface areas. Attrition of the kerogen-rich shale in the dense phase fluidized bed at a superificial gas velocity of 7–14 ft/sec reduces the size of this porous, friable material and allows it to be removed in the exit gas stream as fines. The larger particles remaining in the fluidized bed originated as kerogen-lean shale and thus lack the surface area and resulting sorption capacity to adversely affect retorting. These relatively coarse, attrition resistant, non-oil sorbing particles thus may be used effectively as heat-carrying bodies.

In another feature of the invention, recovery of sensible heat from the coarse and fine combusted spent shale particles is accomplished in two separate coarse and fine fluidized bed coolers operated at specific conditions to maximize heat transfer and energy utilization.

21 Claims, 4 Drawing Figures

PROCESS FOR MAXIMIZING OIL YIELD IN THE RETORTING OF OIL SHALE

This application is a continuation-in-part of my copending application on a "Process and Apparatus for Retorting Oil Shale", Ser. No. 884,492, filed Apr. 8, 1978 now abandoned.

BACKGROUND OF THE INVENTION

The present invention relates to the recovery of oil and gas from oil-bearing shale and, more particularly, to such recovery by retorting processes wherein crushed raw oil shale is heated to convert the kerogen contained therein to vapor to be recovered by appropriate recovery apparatus.

The basic process employed in the present invention includes combusting organic residue on spent shale to heat the heat-carrying bodies which are recycled to the retort for pyrolysis. A number of other processes include the recycling of spent shale as part of the method of oil shale retorting. The majority of these, however, have not even attempted to keep any portion of the spent shale, such as the finely divided, burned shale ash, from the pyrolysis zone, which has been shown to result in high yield losses in these processes due to adsorption and/or absorption of oil in the process which is subsequently lost to the recovery system. Only the process described in U.S. Pat. No. 3,691,056 to J. H. Barney, et al and assigned to the common assignee of the present invention recognizes this deficiency in processes of the prior art and takes steps to prevent combusted spent shale (i.e., shale ash) from recycling to the pyrolysis vessel. The disadvantage of the process described therein, however, is that it assumes that the recycle of all combusted spent shale should be avoided and, as a result, may require a number of separation and attrition steps to effect the separation of combusted spent shale from the heat-carrying bodies and does not identify and, thus, eliminate those particles which are the major cause of the oil loss.

The method described in U.S. Pat. No. 3,703,442, to R. Rammler, et al., although not directly addressing the problem of oil adsorption on shale ash fines, does take steps to keep the burned fine shale ash from the pyrolysis zone, if only for the purpose of reducing the dust loading in the oil vapors leaving the retort. The process described therein, however, does not include combustion within a dense phase fluidized bed and, as a result, requires separate zones other than the burning zone wherein shale ash fines are sifted with separate propellant gas streams, and neither identifies or takes specific steps to differentiate between the sorption capabilities of the particles and to eliminate the particles primarily responsible for the oil loss.

Further, these prior art workers and others have failed to provide a method for maximum recovery of the sensible heat of the spent shale, choosing instead to rely upon standard coolers for effecting a heat exchange relationship between the hot flue gas/shale ash mixture and a heat exchange medium.

For ease of understanding, the two aforementioned processes and their apparatus as disclosed in the patents are set forth in simplified form in FIGS. 1 and 2 respectively.

In the apparatus of FIG. 1, hot heat-carrying bodies 10 are mixed in a rotary drum retort 18 with crushed raw oil shale 12 from source 14 which has been preheated in preheater 16. As the hot heat-carrying bodies 10 and crushed raw oil shale 12 pass through the retort 18, pyrolysis occurs resulting in vapors 20 and solids blend 22 which enter container 24 from retort 18. Vapors 20 are sent to recovery apparatus 26 where the gas and oil content thereof is removed for commercial exploitation. The solids blend 22 is moved into a combustion vessel 28 having a dense phase fluidized bed combustion zone 30 therein. Larger particles within solids blend 22 are first passed through a crusher 32 where they are reduced in size. As the solids blend 22 passes through the dense phase fluidized bed combustion zone 30, a portion of the shale ash therein is attrited by the scrubbing action of the fluidized bed. Ash, and light particles 34 are drawn off by cyclone 36 and pass through a cooler 38 to a bag filter 39 where they are filtered out and removed as residue 40. The cooled, cleaned air 42 is exhausted. The solids blend 22 having passed vertically through the dense phase fluidized bed combustion zone 30 is drawn off through pipe 44 where it is mixed with hot air 46 from source 48. The hot air 46 and heated solids blend 22 pass into an elutriator 50 containing bars or baffles 52 which are struck by the reheated solids blend 22. As the particles are broken by the bars or baffles 52, the ash and light particles 34 produced continue on through with hot air 46 to join the ash and light particles 34 from cyclone 36 entering cooler 38. The heavier particles rejoin the hot heat-carrying bodies 10 to begin the cycle once again.

Referring now to the prior art apparatus of FIG. 2, crushed raw oil shale 12 is once again supplied from a source 14 to be mixed with hot heat-carrying bodies 10 in a rotary drum retort 18. The vapors 20 leaving retort 18 are passed through multiple stages of cyclones 54 wherein the oil-bearing vapors 20 are passed to recovery apparatus 26 and all other solids, ash, and light particles 34 are passed into the bottom of a stand-pipe 56 having hot air 58 passing vertically therethrough. The output of stand-pipe 56 enters a storage container 11' comprising a tortuous path. The heavier particles forming the heat-carrying bodies 10 are unable to exit storage container 11' through the tortuous path. The hot air 58, ash and light particles 34, enter waste heat boiler 60 where cold air 62 from source 64 is heated to provide hot air 58. The cooled air 66 and particles 34 enter cyclone 68 where the heavier particles contained therein are removed is residue 70. The lighter particles and air are cooled by water 72 and pass into an electrostatic precipitator 74 which separates them into cooled gas effluent 76 and residue 70.

As can be seen, in either of the foregoing prior art techniques, the removal of ash is accomplished by apparatus outside of the primary retorting operation, oil recovery therefrom is not maximized, and maximum energy reacovery is not accomplished.

Wherefore, it is the object of the present invention to provide oil retorting apparatus recycling spent shale capable of overcoming the shortcomings of the prior art oil retorting apparatus wherein oil recovery is maximized and lost energy is minimized.

SUMMARY

The foregoing objective has been accomplished by the process of the present invention comprising the steps of pyrolizing oil by heating the oil shale with hot heat-carrying bodies in a pyrolysis zone to form shale oil vapors and a solids blend of cooled heat-carrying bodies and spent shale particles containing fixed carbon, which blend may further contain sorbed oils and vapors trapped in interstices thereof; separating the shale oil vapors from the solids blend in a separation zone and passing the separated shale oil vapors to a recovery zone; stripping and vaporizing the sorbed and trapped oils and vapors from the solids blend in a steam stripping zone and passing the stripped oil and vapors to the separation zone; reheating the cooled heat-carrying bodies in a dense phase fluidized bed combustion zone by combusting therein the fixed carbon contained in the stripped spent shale particles to form hot flue gases and friable shale ash particles; attriting a portion of the friable shale ash particles to fines in the dense phase fluidized bed combustion zone and elutriating the fines from the reheated heat-carrying bodies and remaining shale ash blend by the hot flue gases; stripping flue gases from the elutriated blend in a steam stripping zone; and, recycling the stripped and elutriated blend to the pyrolysis zone to pyrolze fresh oil shale fed therein whereby oil shale recovery from the shale is maximized. To accomplish the energy conservation objectives, the preferred method as described herein additionally comprises the steps of passing the hot flue gases containing the fines through a separation zone to separate the fines from the hot flue gases; accumulating all excess heat-carrying bodies and shale ash blend and passing such accumulated particles through a first heat exchanger, preferably consisting of a first dense phase fluidized bed cooler; passing the hot flue gases through a second heat exchanger to extract the heat therefrom before exhausting the cooled flue gases; passing the fines through a second heat exchanger to extract the heat therefrom before disposing of the cooled fines as residue, the second heat exchanger preferably consisting of a second dense phase fluidized cooler operating at a lower superficial gas velocity than the first preferred fluidized bed cooler; generating steam from water using the extracted heat; and, passing the steam to the stripping zones for use therein in the stripping steps.

To accomplish the foregoing, improved retorting apparatus is shown comprising a retort vessel including mixing means for mixing crushed raw oil shale with heat-carrying bodies wherein the oil shale is pyrolyzed and further including a settling zone for receiving the heavy pyrolyzed oil shale and heat-carrying bodies and a vapor zone for receiving the light vapors and solids from the pyrolyzation process, the mixing means having an input for receiving crushed raw oil shale and hot heat-carrying bodies to be mixed and an output communicating with the settling zone, the settling zone having an output adapted to connect to heating apparatus for heating the heat-carrying bodies; and separator means having an input and a pair of outputs for separating the vapors from the light solids, the input communicating with the vapor zone to receive the vapors and light solids therefrom, one of the outputs containing the vapors and adapted for connection to recovery apparatus for receiving the vapors, the other of the outputs containing the light solids and communicating with the settling zone to deliver the light solids thereto. The apparatus also includes means connected to the retort vessel for passing steam through the settling zone into the vapor zone to strip the solids and heat-carrying bodies of useful components absorbed therein and adsorbed thereon.

DESCRIPTION OF THE PREFERRED EMBODIMENT

Figure 1:
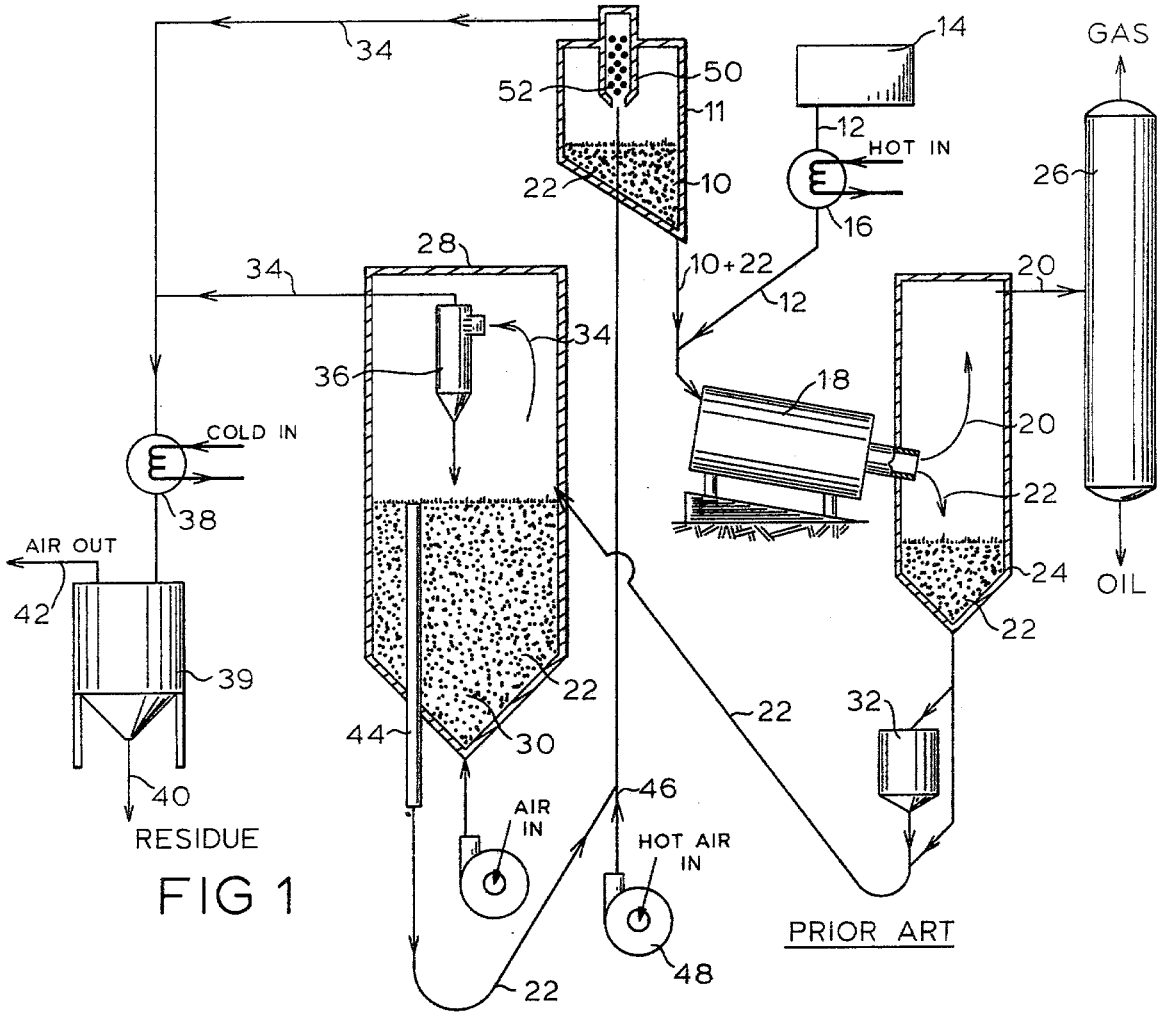
FIG. 1 is a simplified partially cut-away drawing of prior art oil shale retorting apparatus specifically addressing the problem of removing fines produced in the retorting process.
Figure 2:
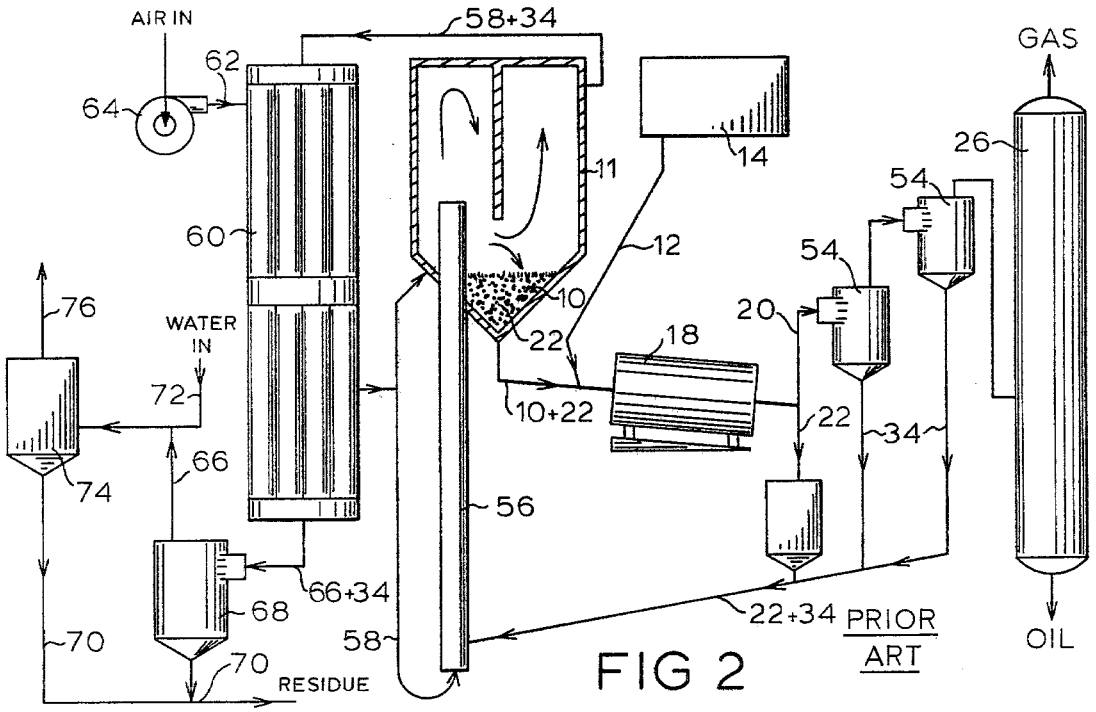
FIG. 2 is a simplified partially cut-away drawing of prior art oil shale retorting apparatus wherein the removal of fines is accomplished incidentally to the retorting method taught.

The terms oil adsorption and oil absorption are terms used hereinafter to describe phenomena which can result in oil yield losses when shale ash particles containing adsorbed or absorbed oils are transferred from the pyrolysis zone to the combustor. The mechanism whereby shale ash particles adsorb oils is believed by the applicant herein to be a function of available surface area and residence time of solid particles within the pyrolysis zone. It is known that pyrolysis of kerogen in oil shale is a process of thermal decomposition producing gases, light and heavy oils, and carbon residue (coke). Oil vapors, particularly of the heavier fractions, adsorb on the surface of solid particles within the pyrolysis zone. These same vapors can also be absorbed within the porous structure of these same particles. If these particles containing adsorbed or absorbed oil vapors remain within the pyrolysis zone for a sufficient length of time (residence time), the oils themselves decompose (crack) to produce lighter oils or gases and coke residue. Once the coke residue is formed, it has no chance of being stripped off the particle by steam stripping or any other means and will simply be burned off in the combustor. The greater the available surface area or porous volume of solid particles within the pyrolysis zone, and the greater the residence time of these particles within the pyrolysis zone, the greater will be the quantity of adsorbed or absorbed oils and the greater will be the quantity of either unstripped oils and/or coke produced which leave the pyrolysis zone to be burned off in the combustor. The greater the quantity of unstripped oils and coke leaving the pyrolysis zone to the combustor, the greater will be the yield losses since these oils and/or coke cannot then be recovered as useful product.

It is also known that in the process of oil shale pyrolysis, particles containing the mineral matrix of the oil shale are formed by decrepitation which particles are very much smaller than the original particles of raw shale. This decrepitation occurs because the kerogen which acts as a binder holding the mineral matrix together is now decomposed and released from the shale. After pyrolysis, these particles which contain carbon residue (coke) are known as spent shale. After combustion of the carbon residue, these particles are known as shale ash. If the raw shale were absolutely uniform in composition, that is, kerogen were distributed homogenously throughout the shale matrix, all spent shale or shale ash particles would be essentially alike in size, physical strength, and chemical composition. Actually, the applicant has found that this is not the case, as all oil shales contain layers rich in kerogen and layers lean in kerogen. Upon pyrolysis, layers rich in kerogen produce spent shale consisting of very small friable, porous particles. Pores are formed by virtue of kerogen decomposing and leaving a cavity behind within the shale matrix. Conversely, shale layers lean in kerogen, produce spent shale consisting of coarse, attrition resistant, non-porous particles. Upon combustin of carbon residue off the coarse particles from lean layers of shale, particles of shale ash are produced which are coarse, attrition resistant and non-porous. Similarly, shale ash from finely divided, friable, porous, spent shale which came from the rich layers of oil shale will be similar in nature to the spent shale from which it came.

It is well-known that finely divided particles have much greater surface areas per unit of weight than coarse particles. For example, surface areas per gram of solid are tabulated below for various particle sizes.

| Particle Size, microns | Surface Area, $cm^2/gm$ |
|---|---|
| 2,000 | 15 |
| 600 | 50 |
| 50 | 600 |
| 10 | 3,000 |
| 1 | 30,000 |

A gram of particles 1 micron in diameter has about 2,000 times more surface area than a gram of particles 2 mm in diameter. Thus, in oil shale retorting, it is desirable that only coarse, attrition resitant, non-porous particles be used as heat carriers introduced into the pyrolysis zone to avoid providing surface area and or pores for oil adsorption or absorption to take place. The present invention is based on implementing this basic method of operation based on the findings of the applicant herein.

Figure 3:
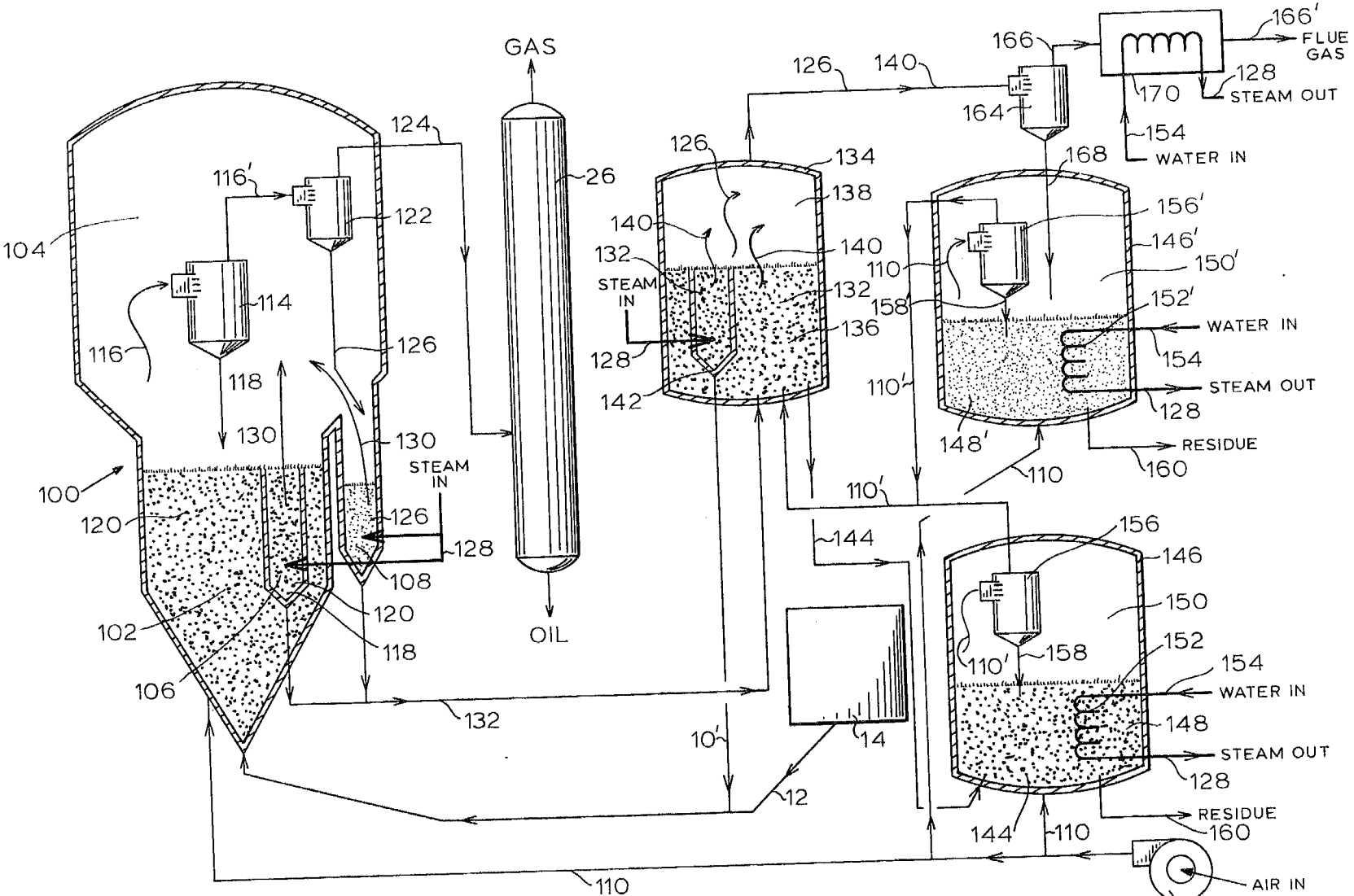
FIG. 3 is a simplified cut-away drawing of oil shale retorting apparatus according to the preferred embodiment of the present invention.

Referring first to FIG. 3, the preferred embodiment of the present invention is shown employing a unitary retort vessel generally indicated as 100. In the preferred embodiment, vessel 100 includes a mixing zone 102, a vapor zone 104 and a pair of stripping zones 106 and 108. The mixing zone 102 comprises a fluidized bed. Hot heat-carrying bodies 10' (produced in a manner to be described hereinafter) are mixed with crushed raw oil shale 12 from source 14 and the two enter into and are mixed together in mixing zone 102 wherein the oil shale is pyrolyzed. A first cyclone 114 is disposed within the vapor zone 104 drawing the vapors blend 116 therein. First cyclone 114 separates the vapors blend 116 into heavier particles 118 which fall back into the solids blend 120 remaining in the mixing zone 102 which comprises the heat-carrying bodies 10 and spent shale particles. The vapors blend 116' exiting first cyclone 114 is drawn into a second cyclone 122 also disposed within the vapor zone 104 of retort vessel 100. Second cyclone 122 separates the vapors blend 116' into recoverable vapors 124 which are sent to recovery apparatus 26. The solids from second cyclone 122 comprise fines and ash 126 which are directed into second stripping zone 108. Stripping zone 106 is in communication with mixing zone 102 whereby heavier particles 118 and solids blend 120 are delivered into stripping zone 106. Steam 128 from an appropriate source is directed through stripping zone 106 and stripping zone 108 to strip off the vapors and vaporized oils 130 absorbed therein, adsorbed thereon, and trapped within the interstices thereof. Vapors and vaporizable oils 130 are then drawn into first cyclone 114 and second cyclone 122 where they are ultimately passed on to the recovery apparatus 26, thereby maximizing the oil recovery within retort vessel 100.

It should be understood at this point that the unitary retort vessel 100 in and of itself comprises an improvement in the state of the art by providing for the maximization of the oil recovery process. It should further be understood that the cyclones 114 and 122 could be mounted outside the vessel 100 having the inputs and outputs thereto connected by appropriate piping passing through the walls of vessel 100.

Further objectives of the present invention are realized by the additional apparatus shown within FIG. 3. In particular, the effluent 132 from retort vessel 100 comprises the steam stripped heat-carrying bodies 10, spent shale particles, and fines and ash 126. Effluent 132 is introduced into the bottom of burner vessel 134 which comprises a dense phase fluidized bed 136 and a vapor zone 138. The fluidized bed 136 of burner vessel 134 is fluidized by air 110 from source 112. The precise routing of air 110 in its path to fluidized bed 136 will be discussed hereinafter. As effluent 132 passes through the dense phase fluidized bed 136, the fixed carbon contained therein is combusted to reheat the heat-carrying bodies 10 and produce flue gases 140. The mixing action of the fluidized bed 136 tends to grind the attritable spent shale particles to release the fines and ash 126 contained therein which are elutriated from the effluent 132 by the flue gases 140. The attrited and elutriated effluent 132 is drawn into a steam stripper 142 disposed within burner vessel 134. As with cyclones 114 and 122, it is to be understood that the steam stripper 142, while preferred to be housed within burner vessel 134, could be disposed outside thereof communicating with the fluidized bed 136 and vapor zone 138 through appropriate connecting conduits. A supply of steam 128 is disposed to pass through steam stripper 142 into vapor zone 138 whereby the flue gases 140 clinging to the effluent 132' therein are driven off into vapor zone 138 to prevent their moving into the retort vessel 100 to contaminate the pyrolyzation process therein. As can be seen, the output of steam stripper 142 comprises the hot heat-carrying bodies 10' referred to above.

As will be understood, since the coarse attrition-resistant shale ash particles are being recycled, the content of burner vessel 134 is constantly increasing beyond the requirements of the retort vessel 100 for hot heat-carrying bodies 10' to be used in the pyrolyzation process. The excess, indicated as 144, is drawn from burner vessel 134 and introduced into first recovery vessel 146 containing a fluidized bed 148 and a vapor zone 150. A heat exchanger 152 is disposed within fluidized bed 148. As hot excess particles 144 pass through fluidized bed 148, the heat therefrom is transferred into heat exchanger 152 where water 154 passed therethrough produces steam, a portion of which is the steam 128 used within the retort vessel 100 and burner vessel 134 for the steam stripping process. Air 110 from source 112 is used in the fluidizing of bed 148. In passing through the fluidized bed 136, air 110 is heated to heated air 110'. It is this preheated air 110' which is employed in the burner vessel 134 in the combustion process of the fixed carbon contained in the spent oil shale particles. In the preferred embodiment as shown, a cyclone 156 is disposed within first recovery vessel 146 to remove any particulate matter 158 from heated air 110' and to return it to the fluidized bed 148. The excess particles composing fluidized bed 148, from which the heat has been extracted, are withdrawn as residue 160.

A second recovery vessel 146' is provided for further heat recovery. A cyclone 164 is disposed in communication with vapor zone 138 of burner vessel 134 to receive the mixture of flue gases 140 and fines and ash 126 contained therein. Cyclone 164 separates the input into cleaned hot flue gases 166 and hot particulate matter 168. The hot particulate matter 168 is fed into the second recovery vessel 146' where it enters an environment substantially identical to that of first recovery vessel 146. That is, a fluidized bed 148' is contained therein connected to receive air 110 which is heated and drawn off by a cyclone 156' to join preheated air 110' from cyclone 156. A heat exchanger 152' is provided to convert water 154 into steam 128 before being withdrawn as residue 160. The hot cleaned flue gases 166 are passed through yet another heat exchanger 170 where water 154 is converted to steam 128 before the cooled flue gases 166' are emitted.

Figure 4:
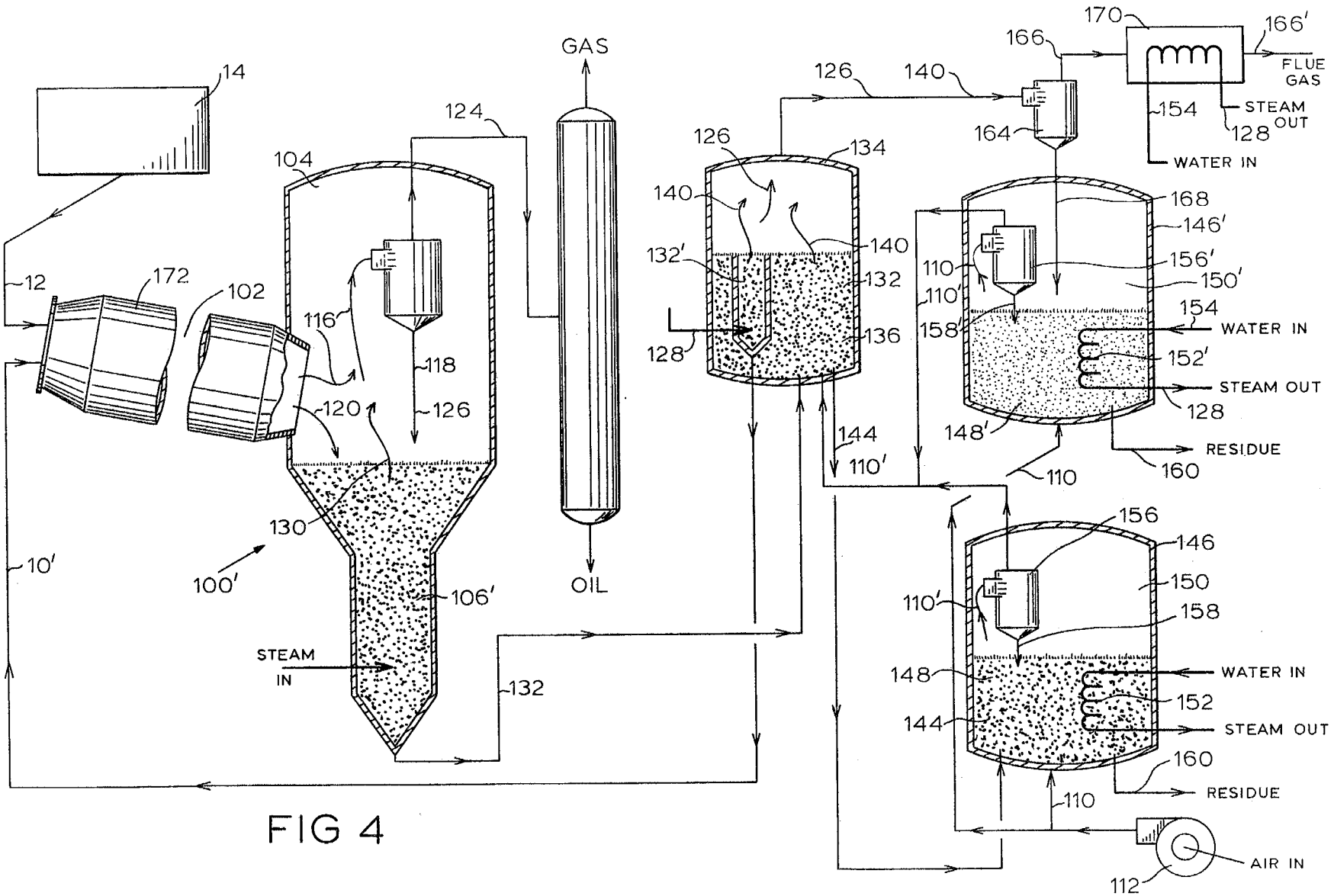
FIG. 4 is a simplified cut-away drawing through oil shale retorting apparatus according to an alternate embodiment of the present invention.

Referring now to FIG. 4, an alternate embodiment of the present invention is shown as comprising a modified unitary retort vessel generally indicated as 100'. In vessel 100' the mixing zone 102 is contained within a rotary drum 172. The crushed raw oil shale 12 from source 14 and the hot heat-carrying bodies 10' are introduced at the inlet to the rotary drum 172. As they pass therethrough, the pyrolyzation process carried out in the fluidized bed of the embodiment of FIG. 3 is accomplished. As with the embodiment of FIG. 3, the vapors blend 116 and solids blends 120 are introduced into the vapor zone 104 and the stripping zone 106' respectively. While two stripping zones such as 106 and 108 employed in the embodiment of FIG. 3 could also be employed in the retort vessel 100' of FIG. 4, FIG. 4 is shown as employing only a single stripping zone 106' wherein all particulate matter is returned. The cyclone 114 (which, as with all cyclones shown in this and the previous embodiment of FIG. 3, could be a plurality of sequential cyclones) separates the input vapors blend 116 into recoverable vapors 124 and all other particulate matter including the heavier particles 118 and the fines and ash 126 which is returned to the stripping zone 106'. The effluent 132 from vessel 100' is substantially identical to the effluent 132 from the retort vessel 100 of FIG. 3. As can be seen, the balance of the processing apparatus is identical to that of the apparatus of FIG. 3.

The process of my invention as described above uses two fluidized beds for cooling shale ash for heat recovery—one for the fine ash entrained overhead from the combustor and one for the coarse ash representing heat-carrying solids in excess of that needed in the pyrolysis zone. Heat recovery by this method is a major improvement over the prior art which only teaches the use of fluidized beds for cooling a stream representing all combined shale ash produced in the retorting of oil shale. The prior art describes cooling of the full-scale size range of shale ash in a single (or parallel units) fluid bed. Cooling is accomplished by transferring heat from the ash to the fluidizing medium, e.g. air, and/or using in-bed heat transfer surfaces, e.g. coils, whereby heat is transferred indirectly to a fluid flowing through the coils. The disadvantage of these methods is that because solid residues from shale retorting consist of such a wide range of particle sizes, e.g. $\frac{1}{4}$ inch to submicron, it is not possible in a single vessel to operate at a fluidizing velocity which will maintain a well mixed fluidized mass, i.e. fluidize the coarse particles, and at the same time keep the very fine entrainable particles in the bed for a sufficient length of time to allow transfer of their contained heat to the fluidizing medium or immersed surfaces. If low velocities are used (e.g. 0.1 to 2 ft/sec) such that the very fine ash (e.g. less than 50 microns) remains in the bed for a sufficient time to affect heat transfer, then the coarse particles (e.g. more than 600 microns) will not be fluidized and thus cannot transfer their heat efficiently because of a lack of intimate contact with either flowing gases or heat transfer surfaces. Conversely, if high velocities are used (e.g. 5–14 ft/sec) such that coarse solids (more than 600 microns) are well fluidized, then the fine particles (e.g. less than 50 microns) will be immediately elutriated upon their introduction into the bed such that sufficient residence time will not be available to effect transfer of their contained heat to the flowing gases or heat transfer surfaces.

The process of the present invention improves upon the prior art in that aforementioned deficiencies are eliminated. By separation of fine and coarse ash in the combustor and cooling these separately in two fluidized beds operating at different velocities, efficient heat transfer is effected such that virtually all the heat contained in the ash is recovered. In particular, the process disclosed herein differs from the Barney et al. patent in that (1) it utilizes a higher fluid velocity in the burner vessel thereby achieving a separation of adsorbing versus non-adsorbing particles and (2) the Barney et al. patent requires additional attriting and elutriating steps downstream of the burner vessel. If it had been obvious to Barney et al. to recycle large spent shale particles, such downstream processing would not be disclosed. Likewise, it is noted that the invention herein substantially differs from Rammler, et al. as well. While the disclosure herein utilizes a single vessel in which the spent shale is separated by particle size and combusted simultaneously, the Rammler et al. patent requires the separate steps of combustion in a lift pipe, separation of shale ash in a sifter or settling chamber, and clean up by a sifter gas. Rammler et al. apparently either failed to appreciate the unexpected fact that larger spent shale particles could be recycled or failed to appreciate the unexpected fact that the spent shale particles with a high affinity for oil could be readily separated from such recyclable particles, thereby allowing separation in a dense phase fluidized bed with resulting improved mixing and mechanical simplicity. While the prior art discloses the use of fluidized bed cooling of spent shale to extract and utilize the heat contained therein, the prior art workers have failed to recognize the improved heat extraction possible by using two or more fluidized beds operating on particles having a more narrow particle range.

Wherefore, it will be apparent from the foregoing description that the methods and apparatus disclosed therein have successfully met the stated objective. Oil recovery is maximized by the steam stripping within the retort vessel of the spent oil shale particles, ash, and fines whereby the vapors and vaporizable oils adsorbed thereon, absorbed therein, and trapped within the interstices thereof are released and included within the vapors sent to the recovery apparatus as well as by the steam stripping of the heat-carrying bodies prior to their return to the pyrolysis vessel from the burner vessel whereby the flue gases which would otherwise contaminate the pyrolization process are removed. In an effort to maximize the recovery of energy consumed in the retorting process, heat contained within flue gases, fines and ash, and excess particulate matter is removed and used to generate steam employed in the aforementioned stripping processes prior to disposal of the gases and particulate matter as flue gases and residue respectively.

OPERATING PARAMETERS

In employing the heretofore described method and apparatus the following operating parameters are preferred to produce recycled shale ash particles which are most oil absorption and adsorption resistant. The crushed raw oil shale should be sized to less than 0.5 inches with less than 0.25 being even more desirable. Preheating of the raw oil shale to at least 220° F. prior to its introduction into the pyrolysis zone is beneficial (although not essential) particularly where the soil is particularly moisture-laden. The preheating drives out the free moisture and reduces the size necessary for the downstream shale oil recovery equipment.

The fluidized bed 102 in the pyrolysis vessel 100 (or rotary drum 172 in the case of vessel 100') is operated at a temperature of 900°-1000° F. and with an average residence time of total solids in the range of 2-15 minutes with 5-10 minutes being most desirable. The fluidized bed 136 in the burner 134 is operated at a temperature of between 1100° F. and 1600° F., preferably between 1200° F. and 1400° F. The burner 134 is operated at superficial fluidization velocities in the range of 7-14 ft./sec with 8-10 ft./sec. being most preferred. At these velocities, it has been found that substantially all the fine shale ash (0-50 microns) is entrained overhead in the vapor zone 138 and removed from the burner by the cyclone 164, leaving a bed which contains little material finer than 600 microns. This residue consists primarily of competent attrition resistant solids which represent that portion of the bulk oil shale ore containing little or no kerogen constituents. This coarse solid residue can safely be recycled to the pyrolysis zone without incurring substantial yield losses resulting from adsorption of oil. Suitable heat carriers of external origin (e.g. silica sand) can be used in addition, if desired.

The coarse solids cooler (first recovery vessel 146) is operated at a velocity of 5-14 ft./sec. (with 6-8 ft./sec. best). The fines cooler (second recovery vessel 146') is operated at fluidization velocities from 0.1-2 ft./sec. (1-1.5 ft./sec. best).

In the process of my invention relating to the pyrolysis of oil shale, the claimed operating range of 7-14 ft/sec as a superficial fluidization velocity in the fluid bed combustor required to separate fine from coarse shale ash particles is distinct from the operation of the apparatus of the Barney et al. patent. The Barney et al. patent teaches the use of two distinct stages of separation for removing fine shale ash particles from coarse heat carriers. The first stage of the separation occurs in a dense phase fluid bed combustion zone operating at a superficial fluidization velocity of 2.5 to 6.0 ft./sec. A second stage of attrition and elutriation occurs downstream of the combustion zone in a heat carrier accumulation zone which contains an elutriator equipped with a plurality of attriter bars or baffles. It is taught that in addition to attriting and comminuting friable shale ash particles, this second stage elutriator also serves "to disperse the shale ash fines so as to *significantly improve* the elutriation thereof from the heat-carrying bodies." The Barney et al. invention, therefore, teaches that a single fluidized bed combustor operating at 2.5 to 6 ft/sec is not *by itself* sufficient to effect efficient fines separation but requires, in addition, a second stage of elutriation. It was, apparently, not obvious that the velocity in the combustor could be increased to 7-14 ft/sec to achieve the same overall degree of elutriation and attrition. If such results had been apparent, then a second stage of elutriation and attrition would not have been provided for.

Wherefore, having thus described my invention, I claim:

1. A process for the recovery of shale oil from oil-bearing shale comprising the steps of:

(a) pyrolyzing oil shale by heating the oil shale with heat-carrying bodies comprising relatively coarse attrition resistant, non-oil sorbing shale ash solids in a pyrolysis zone to form shale oil vapors and a solids blend of cooled heat-carrying bodies and spent shale particles containing fixed carbon, said solids blend further containing sorbed oils and vapors trapped in interstices thereof;

(b) separating the shale oil vapors from said solids blend in a separation zone and passing the separated shale oil vapors to a recovery zone;

(c) stripping and vaporizing the sorbed and trapped oils and vapors from said solids blend in a steam stripping zone and passing the stripped oils and vapors to said separation zone;

(d) reheating the cooled heat-carrying bodies in a dense phase fluidized bed combustion zone by combusting therein the fixed carbon contained in the stripped spent shale particles to form hot flue gases and shale ash comprising friable, oil sorbing particles and relatively coarse, attrition resistant, non-oil sorbing particles;

(e) attriting a substantial portion of the friable shale ash particles to fines in the dense phase fluidized bed combustion zone and elutriating the fines from the blend of reheated heat-carrying bodies and remaining relatively coarse, attrition resistant, non-oil sorbing, shale ash particles by the hot flue gases;

(f) stripping flue gases from said elutriated blend in a steam stripping zone; and, (g) recycling said stripped and elutriated blend comprising relativley coarse, attrition resistant, non-oil sorbing shale ash particles to the pyrolysis zone to pyrolyze fresh oil shale fed therein whereby oil recovery from the shale is maximized.

2. The method of claim 1 and additionally comprising the steps of:

(a) passing the hot flue gases containing the fines through a separation zone to separate the fines from the hot flue gases;

(b) passing the hot flue gases through a heat exchanger to extract the heat therefrom before exhausting the cooled flue gases;

(c) passing the fines through a heat exchanger to extract the heat therefrom before disposing of the cooled fines as residue;

(d) generating steam from water using said extracted heat; and, (e) passing said steam to said stripping zones for use therein in said stripping steps.

3. The method of claim 1 and additionally comprising the steps of:

(a) extracting the portion of the stripped and elutriated relatively coarse, attrition resistant shale ash particles in excess of that needed in the pyrolysis zone;

(b) passing said extracted portion through a heat exchanger to extract the heat therefrom before disposing of the cooled portion as residue;
(c) generating steam from water using said extracted head; and,
(d) passing said steam to said stripping zone for use therein in said stripping steps.

4. A process for the recovery of shale oil from oil-bearing shale comprising the steps of:
(a) pyrolyzing oil shale in a pyrolysis zone by contacting the oil shale with hot heat-carrying solids comprising relatively coarse attrition-resistant shale ash solids to form shale oil vapors, and a solids blend of cooled heat-carrying solids and spent shale particles containing fixed carbon;
(b) passing the shale oil vapors to a recovery zone;
(c) passing the solids blend to a dense phase fluid bed combustion zone;
(d) reheating the cooled heat-carrying solids in said combustion zone by combusting the fixed carbon contained in the spent shale particles and attriting the friable spent shale particles therein at a temperature of between about 1100°–1600° F. and a superficial fluidization velocity of between about 7–14 ft/sec to form hot flue gases containing substantially all the fine shale ash particles and a bed comprising competent attrition-resistant, relatively coarse, heat-carrying solids;
(e) withdrawing the hot flue gas and fine shale particles from the fluid bed combustion zone; and,
(f) recycling said heat-carrying solids to the pyrolysis zone to pyrolyze fresh oil shale therein whereby oil recovery is maximized.

5. The process according to claim 4 and additionally comprising the steps of:
(a) passing the hot flue gases containing fines through a separation zone to separate the fines from the hot flue gases;
(b) passing the hot flue gases through a first heat exchanger to extract the heat therefrom before exhausting the cooled flue gas;
(c) passing the fines to a first fluidized bed heat exchanger;
(d) fluidizing the fines in said first fluidized bed heat exchanger with air at a superficial fluidization velocity of between about 0.1 to 2.0 ft/sec to preheat the air and cool the fines;
(e) passing said preheated air to said fluidized bed combustion zone for use in combusting the carbon on the spent shale; and,
(f) withdrawing the cooled fines from said first fluidized bed heat exchanger.

6. The process according to claim 5 and additionally comprising the steps of:
(a) extracting a portion of the heat-carrying solids in excess of that needed in the pyrolysis zone;
(b) passing said extracted solids to a second fluidized bed heat exchanger;
(c) fluidizing said extracted solids in said second fluidized bed heat exchanger with air at a superficial fluidization velocity of between about 5 to 14 ft/sec to preheat the air and cool the solids;
(d) passing the preheated air to said fluidized bed combustion zone for use in combusting the carbon on the spent shale; and
(e) withdrawing the cooled solids from said second fluidized bed heat exchanger.

7. The process according to claim 4 wherein said fluidized bed combustion zone is operated at a temperature between about 1200°–1400° F.

8. The process according to claim 4 wherein said fluidized bed combustion zone is operated at a superficial fluidization velocity of between about 8–10 ft/sec to entrain fine shale ash having a particle size smaller than about 600 microns from the fluid bed in the flue gas stream.

9. The process according to claim 8 wherein substantially all of the fine shale ash particles having a particle size smaller than about 50 microns are entrained in the flue gas and removed from the fluid bed.

10. The process according to claim 4 wherein the blend of cooled heat-carrying solids and spent shale particles, which may contain sorbed oils and vapors trapped in interstices thereof, is steam stripped to remove trapped oil and vapors therefrom.

11. The process according to claim 4 wherein the reheated heat-carrying solids are steam stripped to remove trapped flue gases prior to withdrawal from the fluid bed combustion zone.

12. In a process for the recovery of shale oil from oil-bearing shale wherein spent shale is recycled to provide at least a portion of the heat-carrying bodies employed in retorting the oil-bearing shale, the improvement for maximizing the amount of oil vapor produced by the retorting of the oil-bearing shale comprising the steps of:
(a) receiving the spent shale from the retorting operation;
(b) combusting the spent shale in a dense phase fluid bed combustion zone at a temperature and fluidization velocity sufficient to form a hot flue gas stream containing substantially all the shale ash particles of maximum oil adsorption and absorption capability and a bed comprising heat-carrying solids of minimum oil adsorption and absorption capability; and,
(c) recycling said solids from said bed to the retort.

13. The improvement to an oil-shale retorting process as claimed in claim 12 wherein:
said fluid bed combustion zone is operated at a temperature range of 1100°–1600° F. and a superficial fluidization velocity range of 7–14 ft/sec.

14. The improvement to an oil-shale retorting process as claimed in claim 12 wherein:
said fluid bed combustion zone is operated at a temperature range of 1200°–1400° F.

15. The improvement to an oil-shale retorting process as claimed in claim 12 wherein:
said fluid bed combustion zone is operated at a superficial fluidization velocity range sufficient to entrain fine shale ash having a particle size smaller than about 600 microns from the fluid bed in the flue gas stream.

16. The improvement to an oil-shale retorting process as claimed in claim 15 wherein:
said fluid bed combustion zone is operated so as to remove substantially all the fine shale ash particles smaller than 50 microns from the fluid bed.

17. The improvement to an oil-shale retorting process as claimed in claim 12 and additionally including the step of:
steam stripping the solids within said bed to remove trappd flue gases prior to said step of recycling to the retort.

18. The improvement of an oil-shale retorting process as claimed in claim 12 and further comprising the steps of:

(a) extracting a portion of the heat-carrying solids in excess of that needed in the retort;

(b) cooling the excess heat-carrying solids in a first fluidized bed cooler whereby the sensible heat therein may be extracted and utilized;

(c) separating the shale ash particles from the hot flue gas stream; and, (d) cooling the shale ash particles in a second fluidized bed cooler whereby the sensible heat therein may be extracted and utilized.

19. The improvement to an oil-shale retorting process as claimed in claim 18 wherein:

said first fluidized bed cooler is operated at a superficial fluidization velocity of between about 5 and 14 ft/sec and said second fluidized bed cooler is operated at a superficial fluidization velocity of between about 0.1 and 2.0 ft/sec.

20. In a process for the recovery of shale oil from oil-bearing shale by the retorting of oil-bearing shale in the presence of heat-carrying bodies, the improvement for maximizing the amount of oil vapor produced by the retorting of the oil-bearing shale comprising:

retorting the oil-bearing shale with heated shale ash having a low affinity for oil as at least a portion of the heat-carrying bodies.

21. In a process for the recovery of shale oil from oil-bearing shale by the retorting of oil-bearing shale in the presence of heat-carrying bodies to produce shale oil and spent oil shale, the improvement for maximizing the energy utilization of the process comprising:

(a) separating the spent oil shale into at least two size categories of separated particles;

(b) transferring separate size categories of separated particles to separate fluidized bed coolers; and (c) extracting the heat from each size category of separated particles in the separate fluidized bed coolers wherein each fluidized bed cooler is operated at a superficial gas velocity chosen to effect fluidization of the entire range of particles located therein in indirect heat exchange with a heat exchange means containing a heat exchange media.

* * * * *